United States Patent [19]

DeVries

[11] 4,425,307

[45] Jan. 10, 1984

[54] HYDROGEN PEROXIDE IN SULFURIC ACID EXTRACTION OF URANIUM ORES

[75] Inventor: Frederick W. DeVries, Chadds Ford, Pa.

[73] Assignee: E. I. Du Pont de Nemours & Co., Wilmington, Del.

[21] Appl. No.: 256,675

[22] Filed: Apr. 22, 1981

[51] Int. Cl.[3] ..... C01G 43/00; C22B 3/00

[52] U.S. Cl. ..... 423/20; 299/5

[58] Field of Search ..... 423/18, 20; 299/5

[56] References Cited

U.S. PATENT DOCUMENTS

| | | | |
|---|---|---|---|
| 3,309,140 | 3/1967 | Gardner | 423/20 |
| 3,713,698 | 1/1973 | Rhoades | 299/4 |
| 4,082,359 | 4/1978 | Spence | 299/4 |
| 4,083,603 | 4/1978 | Stover | 299/4 |
| 4,175,108 | 11/1979 | Poitte | 423/20 |
| 4,214,791 | 7/1980 | Moore | 299/5 |

OTHER PUBLICATIONS

Merritt, *The Extractive Metallurgy of Uranium,* col. School of Mines Res. Inst. (1971), Ch. 5, 15.

Barb et al., "Reactions of Ferrous and Ferric Ions with Hydrogen Peroxide", *Trans. Faraday Soc.,* 1950.

Amell et al., U.S. Department of the Interior, Bureau of Mines Contract No. H0272019 Final Report (NTIS-PB299947/AS (1978).

Shabbir et al., U.S. Department of the Interior, Bureau of Mines (Jul. 1974), (MTIS PB-234 691).

Brown et al., "Uranium Precipitation with Hydrogen Peroxide", (Feb. 1980) AIME, Preprint 80-63.

Eliwe et al., *Metall,* vol. 36, No. 2, Feb. 1982, pp. 135-140.

Gunn et al., *Canadian Journal of Technology,* vol. 34, Nov. 1956, pp. 379-388.

*Primary Examiner*—Brian E. Hearn

[57] ABSTRACT

Uranium can be extracted from its ores at a pH of 2.5 to 5.5 using sulfuric acid, hydrogen peroxide, trace of iron and a sulfate. The extraction process is applicable to both tank leaching of conventionally mined ores and in situ leaching.

5 Claims, No Drawings

HYDROGEN PEROXIDE IN SULFURIC ACID EXTRACTION OF URANIUM ORES

BACKGROUND OF THE INVENTION

1. Field of the Invention

The present invention relates to a process for the extraction of uranium from its ores using sulfuric acid. The invention is particularly directed to an extraction at a pH range of 2.5 to 5.5 using sulfuric acid, hydrogen peroxide and a sulfate.

2. Prior Art

It is well known how to recover uranium from its ores by converting the relatively insoluble tetravalent state of uranium in the ore to the soluble hexavalent state. Most of this uranium ore processing employs leaching in dilute sulfuric acid. Normally, this sulfuric acid leaching is carried out at pH≦1 with an oxidant added to raise the uranium (IV) to uranium (VI), R. C. Merritt, The Extractive Metallurgy of Uranium, Chapters 5 & 15, (1971), Colorado School of Mines Research Institute. At these pH levels, however, a powerful oxidation phenomenon, known as Fenton's Reagent does not function, as this phenomenon requires hydrogen peroxide, traces of dissolved ferrous ion and an absence of dissolved ferric ion. pH levels of 3 or more preclude dissolved ferric ion and allow the phenomenon to occur, W. G. Barb, J. H. Baxendale, P. George & K. R. Hargrave, "Reactions of Ferrous and Ferric Ions with Hydrogen Peroxide," (received July 1950) Transactions of the Faraday Society. Additionally sufficient iron for the required ferrous ion is present in most uranium ores.

At pH of 2.5 to 6.5 uranium normally forms an insoluble peroxide with hydrogen peroxide, and any extracted uranium under Fenton's Reagent conditions would be reprecipitated and lost, A. R. Amell and D. Langmuir, "Factors Influencing the Solution Rate of Uranium Dioxide under Conditions Applicable to In Situ Leaching" (NTIS-PB299947/AS) Nov. 20, 1978) U.S. Department of Interior Bureau of Mines Contract No. HO272019 Final Report. Sulfates, however, are known to inhibit peroxide precipitation, M. Shabbir & K. E. Tame, "Hydrogen Peroxide Precipitation of Uranium" (MTIS PB-234 691), (July 1974) U.S. Department of Interior Bureau of Mines, and R. A. Brown, "Uranium Precipitation with Hydrogen Peroxide," (February 1980) Society of Mining Engineers of AIME, Littleton, Colo., Preprint No. 80-63.

In in situ leaching of uranium from, for example, porous sandstone deposits, use of low pH leach solutions has continued to cause problems of high levels of acid consumption and impurity pick-up via sulfuric acid attack on gangue material. As a result, this process (acid in situ leaching) has achieved very limited commercialization.

The novel uranium extraction process described hereinafter is applicable to both tank leaching of conventionally mined ores and in situ leaching and results in substantially lower acid requirements.

SUMMARY OF THE INVENTION

According to the present invention it has been found that uranium can be extracted from its ores at a pH of 2.5 to 5.5 using sulfuric acid, hydrogen peroxide, a trace of iron and an excess of recyclable, neutral sulfate to allow the extraction of the uranium without precipitation of uranium peroxide. The leach solution containing dissolved uranium can be separated from the gangue materials and recovered by conventional means, either solvent extraction or use of ion exchange resin.

The present invention also relates to a process for the solution mining of a uranium ore deposit, where an aqueous solution is passed through the ore deposit to dissolve the uranium in the deposit thereby enriching the leaching solution which is withdrawn from the ore deposit. The leaching solution is an aqueous solution containing sulfuric acid, hydrogen peroxide, a trace of iron and a neutral sulfate at a pH of 2.5 to 5.5.

DETAILED DESCRIPTION OF THE INVENTION

Sulfuric acid addition is accomplished as known in the art and the amount added is a function of the desired pH and the specific ore being leached. The pH range covered by the process is 2.5 to 5.5. The higher the pH that can be used, the less acid required.

The hydrogen peroxide used can be any of the commercial grades available on the market. Commercial grades of hydrogen peroxide contain various types of stabilizers depending upon a particular end-use to which a particular grade is distined. For the present invention, none of the stabilizers in the commercial grades of hydrogen peroxide appear to have an adverse effect on the oxidation of uranium (IV) to the hexavalent state. Hydrogen peroxide concentration must be optimized for the specific leach. The ideal range would use the most peroxide that can be added without overcoming the inhibition of precipitation by the sulfate present. Hydrogen peroxide additions up to a range of $2.0\times10^{-2}$ molar based on the leach solution can be used; the preferred range is 1.0 to $1.6\times10^{-2}$ molar.

Suitable neutral sulfates are sodium, potassium or magnesium sulfates. Sodium is a preferred cation. Additionally, though it is not neutral, ammonium sulfate would be suitable. Sulfate concentration of 0.1 molar or more shows improved uranium extraction. The maximum effect required at least 0.8 molar based on the leach solution. Above 1.6 molar, little additional effect was noted.

Under conditions of this process most ores will contain sufficient iron to allow oxidation of the uranium. At higher pH ranges or with ores containing very little iron, traces of ferrous salts, around 1 ppm based on the leach solution, might have to be added.

EXAMPLE 1

The low-grade New Mexico ore sample used in this example was analyzed as follows:

| Wet Screen Analysis | |
|---|---|
| Tyler Screen Size | Weight % |
| −20 + 48 | 36 |
| −48 + 65 | 23 |
| −65 + 100 | 13 |
| −100 + 200 | 10 |
| −200 + 325 | 3 |
| −325 | 15 |

The ore analyzed chemically as follows:

$SiO_2$—88.6%
$Al_2O_3$—6.6
$K_2O$—1.9
$Fe_2O_3$—1.0
$U_3O_8$—0.18

This ore was stirred at 1600 rpm in a tank at a pulp density of 25%, a pH of 4.0±0.1 from addition of $H_2SO_4$, a temperature of 30° C., and $H_2O_2$ content of $1.31\times10^{-2}$ mole/l.

The following table illustrates the beneficial effect of uranium yields caused by the addition of neutral sulfate:

TABLE 1-1

| Moles/liter $SO_4^=$ | Uranium Yields @ 2 hrs. | @ 4 hrs. |
|---|---|---|
| 0.04 | 15% | 22% |
| 0.15 | 36 | 36 |
| 0.40 | 42 | 45 |
| 0.60 | 48 | 51 |
| 1.00 | 52 | 55 |

The need for $H_2O_2$ as an oxidant in this system is illustrated in the following table, as is the loss of yield if $H_2O_2$ concentration is so high that uranyl peroxide precipitates despite the inhibition of the neutral sulfates. In these runs, pulp density was again 25%, pH 4.0±0.1, agitation rate 1600 rpm, and Example 1 ore was used. Neutral sulfate was added as sodium sulfate to 1.0 moles/liter.

TABLE 1-2

| Moles/liter $H_2O_2\times10^{-2}$ | Uranium Yields @ 4 hrs. |
|---|---|
| 0 | 27% |
| 0.33 | 37 |
| 0.66 | 41 |
| 0.98 | 48 |
| 1.31 | 54 |
| 1.47 | 50 |
| 1.97 | 46 |

Yield improvement, as a function of increasing leach temperature is illustrated in Table 1-3; ore, pulp density, agitation, and sulfate content of 1.0 molar, are as in Table 1-2. With $H_2O_2$ fed at $1.31\times10^{-2}$ moles/liter, yield data were:

TABLE 1-3

| T °C. | Uranium Yields @ 4 hrs. |
|---|---|
| 30 | 54% |
| 40 | 55 |
| 50 | 61 |
| 60 | 68 |
| 70 | 73 |
| 80 | 89 |

EXAMPLE 2

The ore used in this example was from the same ore body as that in example 1. However, it contained only 0.06% $U_3O_8$. As in example 1, a pulp density of 25% and 1600 rpm agitation were used. At 30° C., $1.31\times10^{-2}$ moles/liter of $H_2O_2$, and a pH of 4, improvement via addition of neutral sulfate is shown below:

TABLE 2-1

| Moles/liter $SO_4^=$ | Uranium Yields @ 4 hrs. |
|---|---|
| 0.15 | 35% |
| 0.40 | 40 |
| 0.60 | 48 |
| 1.00 | 53 |

At 1.00 mole/liter $SO_4^{--}$, dependency on $H_2O_2$ is shown below:

TABLE 2-2

| Moles/liter $H_2O_2\times10^{-2}$ | Uranium Yields @ 4 hrs. |
|---|---|
| 0 | 25% |
| 0.33 | 34 |
| 0.66 | 38 |
| 0.98 | 45 |
| 1.31 | 53 |
| 2.0 | 48 |

As in example 1, too much $H_2O_2$ will overcome the sulfate inhibition of uranyl peroxide precipitation. The yield at $2.0\times10^{-2}$ moles $H_2O_2$/liter is lower than at $1.31\times10^{-2}$.

The ore in Example 2 was somewhat more refractory than that in Example 1. Yields were lower even in the high temperature runs. However, the values obtained mirror closely those in example 1.

TABLE 2-3

| T °C. | Uranium Yields @ 4 hrs. |
|---|---|
| 30 | 40% |
| 40 | 50 |
| 50 | 54 |
| 60 | 62 |
| 70 | 70 |
| 80 | 79 |

Although the optimum pH for the parameters used was 4.0, even at pH 5 substantial extraction of uranium was achieved in the presence of $1.31\times10^{-2}$ moles $H_2O_2$ and 1.0 mole $SO_4^{--}$/liter, at 30° C.

TABLE 2-4

| pH | Uranium Yields @ 4 hrs. |
|---|---|
| 4.0 | 53% |
| 5.0 | 40 |
| 6.0 | 20 |

At pH 6, other conflicting mechanisms reduced leaching yields.

Example 3

A similar effect was seen in leaching experiments using a high-alkalinity Texas ore containing 0.074% $U_3O_8$. Under similar conditions, the following results were obtained:

TABLE 3-1

| pH | Uranium Yields @ 4 hrs. |
|---|---|
| 4.0 | 53% |
| 5.0 | 37 |
| 6.0 | 30 |

I claim:

1. In a process for the extraction of uranium from its ores with a leach solution wherein the uranium is oxidized to uranium (VI) oxidation state and then extracted, the improvement which comprises extracting the uranium in the absence of ferric ion at a pH of 2.5 to 5.5 with sulfuric acid, hydrogen peroxide, a trace of ferrous iron and between 0.1 and 1.6 mols of a neutral sulfate per mol of leach solution.

2. In a process for the solution mining of a uranium ore deposit where an aqueous leaching solution is passed through the ore deposit to dissolve the uranium is withdrawn from the ore deposit, the improvement comprising: passing through the deposit an aqueous leaching solution containing sulfuric acid, hydrogen peroxide, and between 0.1 and 1.6 mols of a neutral sulfate per mol of leach solution at a pH of 2.5 to 5.5 in the presence of ferrous iron and the absence of ferric ion.

3. A process of claim 1 or 2 wherein the sulfate is sodium sulfate.

4. A process of claim 1 or 2 wherein the concentration of the sulfate is 0.5 to 1.6 molar based on the leach solution.

5. A process of claim 1 or 2 wherein the concentration of the sulfate is 0.8 to 1.2 molar based on the leach solution.

* * * * *